US009748686B1

(12) United States Patent
Milo et al.

(10) Patent No.: US 9,748,686 B1
(45) Date of Patent: Aug. 29, 2017

(54) BGA SPRING PROBE PIN DESIGN

(71) Applicant: Texas Instruments Incorporated, Dallas, TX (US)

(72) Inventors: Michael Flores Milo, Baguio (PH); Dolores Babaran Milo, Baguio (PH)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/043,682

(22) Filed: Feb. 15, 2016

(51) Int. Cl.
*H01R 13/24* (2006.01)
*H01R 43/20* (2006.01)

(52) U.S. Cl.
CPC ..... *H01R 13/2421* (2013.01); *H01R 43/205* (2013.01)

(58) Field of Classification Search
CPC ..... H01R 13/2421; H01R 2201/20; H01R 13/187; H01R 13/6315; G01R 3/00; G01R 1/06738; G01R 1/06711; G01R 1/06772; G01R 31/2889; G01R 1/06716; G01R 1/06727; G01R 31/2886; G01R 1/0483; G01R 31/2887
See application file for complete search history.

(56) References Cited

U.S. PATENT DOCUMENTS 5,221,209 A * 6/1993 D'Amico ..... G01R 1/0483 439/66
5,518,410 A * 5/1996 Masami ..... H05K 7/1069 324/750.25
5,702,255 A * 12/1997 Murphy ..... H01R 13/2478 439/71
6,464,511 B1 * 10/2002 Watanabe ..... G01R 1/07371 439/66
7,367,813 B2 * 5/2008 Matsuo ..... G01R 1/0466 439/66
7,438,586 B2 * 10/2008 Ju ..... H01R 13/112 439/398
7,467,908 B2 * 12/2008 Francavilla ..... G01F 11/025 222/325
7,473,104 B1 * 1/2009 Wertz ..... H01R 13/28 439/66
7,491,069 B1 * 2/2009 Di Stefano ..... G01R 1/0491 439/74
7,682,165 B2 * 3/2010 Liao ..... H05K 3/3426 439/342
7,946,855 B2 * 5/2011 Osato ..... H05K 7/1069 324/755.05
8,033,877 B2 * 10/2011 Di Stefano ..... H05K 3/32 439/851
8,147,253 B2 * 4/2012 Goodman ..... H01R 13/2407 439/66
8,210,855 B1 * 7/2012 Lin ..... H01R 12/716 439/66
8,441,275 B1 * 5/2013 Alladio ..... G01R 1/0466 324/756.01
8,912,811 B2 * 12/2014 Sherry ..... G01R 1/06716 324/754.03

(Continued)

*Primary Examiner* — Xuong Chung Trans
(74) *Attorney, Agent, or Firm* — Tuenlap D. Chan; Charles A. Brill; Frank D. Cimino

(57) ABSTRACT

An improved BGA spring probe pin with a spring actuated solder ball receptacle that grips the sides of the solder ball during probing. A method of operating a BGA prober with improved BGA spring probe pins.

19 Claims, 5 Drawing Sheets

(56) References Cited

U.S. PATENT DOCUMENTS

| | | | | |
|---|---|---|---|---|
| 8,926,376 | B2 * | 1/2015 | Mori | H01R 13/2421 439/482 |
| 9,105,994 | B2 * | 8/2015 | Suzuki | H01R 11/18 |
| 9,214,746 | B2 * | 12/2015 | Kobayashi | H01R 13/2435 |
| 2007/0249240 | A1 * | 10/2007 | Chiang | H05K 3/3426 439/850 |

* cited by examiner

BGA SPRING PROBE PIN DESIGN

FIELD

This invention relates an improved force biased spring probe pin for probing ball grid arrays.

BACKGROUND

Spring probe pins are also often referred to as Pogo™ pins. Pogo™ is a registered trademark of Xcerra Corporation in Norwood, Mass. A spring probe pin or Pogo™ pin is a device used in electronics to establish electrical connection between two circuits. Pogo™ pins are usually arranged in a dense array, connecting together many individual nodes of two circuits or circuit boards. Pogo™ pin connectors are commonly found in automatic test equipment (ATE) in the form of a bed of nails where they facilitate the formation of rapid, reliable, temporary, electrical connections to devices under test. A Pogo™ pin connector may contain just a few Pogo™ pins or may contain many hundreds of Pogo™ pins.

One type of packaged integrated circuit that Pogo™ pins are used to electrically test is a ball grid array (BGA) package 100 such as is shown in FIG. 1. An integrated circuit (IC) is packaged in the BGA package 100. An array of solder balls 102 which may vary from a few solder balls to greater than 500 solder balls provides electrical connection between the IC in the BGA package and the circuit board on which the BGA package is mounted.

A typical BGA Pogo™ pin connector design used to electrically test solder ball connections on a BGA package 100 is shown in FIG. 2A. A cup shaped solder ball receptacle 204 which is about half the diameter of the solder ball 220 or less is mounted on a Pogo™ pin plunger 202. The Pogo™ pin plunger 202 may be spring loaded to provide similar pressure to solder balls that may be of various diameters.

As shown in FIG. 2B during electrical testing of the BGA package 100, the cup shaped solder ball receptacle 204 on the BGA Pogo™ pin is lowered so that the rim of the cup shaped solder ball receptacle 204 comes into contact with and forms electrical contact to the solder ball 220 on the BGA package 100.

A second typical Pogo™ pin connector design used to electrically test solder ball connections on a BGA package 100 is illustrated in FIG. 3A. The rim of the cup shaped solder ball receptacle 304 in this design has a crown design with crown points 306 around the rim of the cup 304.

As shown in FIG. 3B during electrical testing of the BGA package 100, the cup shaped solder ball receptacle 304 on the BGA Pogo™ pin is lowered so that the crown points 306 on the rim of the cup shaped solder ball receptacle 304 form electrical contact with the solder ball 210 on the BGA package 100. The crown points 306 provide increased pressure against the solder balls 210 to provide more reliable electrical contact. This type of design may extend the interval that the BGA Pogo™ pin may be used before replacement.

SUMMARY

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to a more detailed description that is presented later.

An improved BGA spring probe pin with a spring actuated solder ball receptacle that grips the sides of the solder ball during probing. A method of operating a BGA prober with improved BGA spring probe pins.

DETAILED DESCRIPTION OF EXAMPLE EMBODIMENTS

Embodiments of the disclosure are described with reference to the attached figures. The figures are not drawn to scale and they are provided merely to illustrate the disclosure. Several aspects of the embodiments are described below with reference to example applications for illustration. It should be understood that numerous specific details, relationships, and methods are set forth to provide an understanding of the disclosure. One skilled in the relevant art, however, will readily recognize that the disclosure can be practiced without one or more of the specific details or with other methods. In other instances, well-known structures or operations are not shown in detail to avoid obscuring the disclosure. The embodiments are not limited by the illustrated ordering of acts or events, as some acts may occur in different orders and/or concurrently with other acts or events. Furthermore, not all illustrated acts or events are required to implement a methodology in accordance with the present disclosure.

Figure 1:
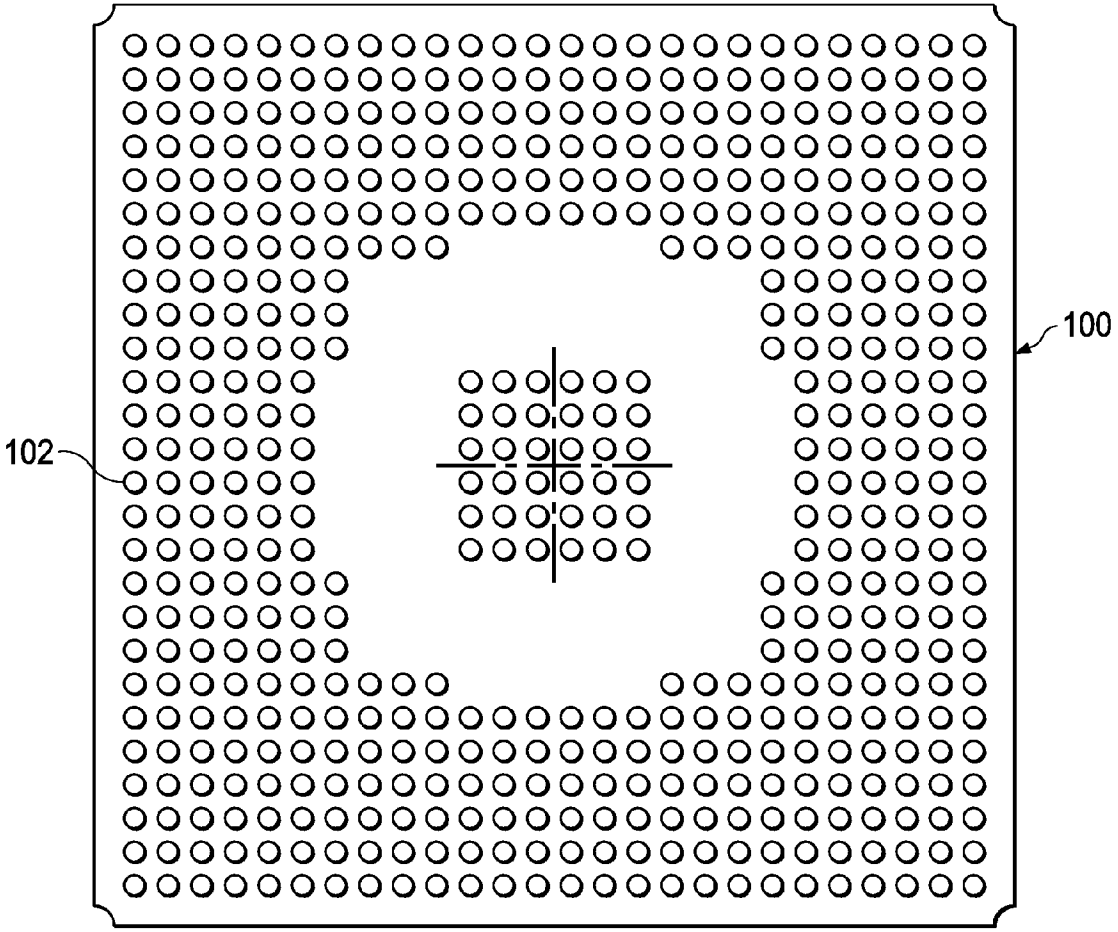
FIG. 1 (PRIOR ART)
FIG. 1 (Prior art) is a top down view of a ball grid array (BGA) packaged IC.
Figure 3B:
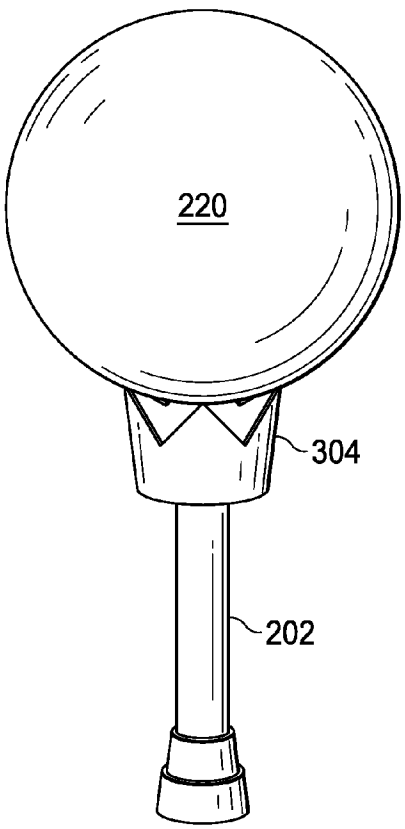
FIG. 3B (PRIOR ART)
FIGS. 3A and 3B are side views of a typical spring probe pin for electrically testing solder balls on a BGA package.
Figure 3A:
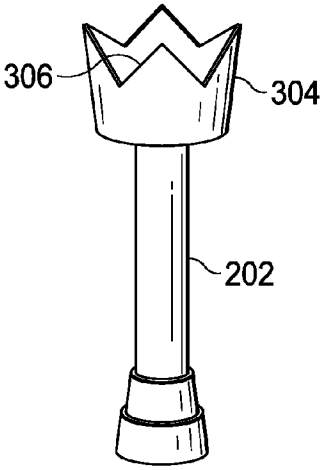
FIG. 3A (PRIOR ART)
Figure 2B:
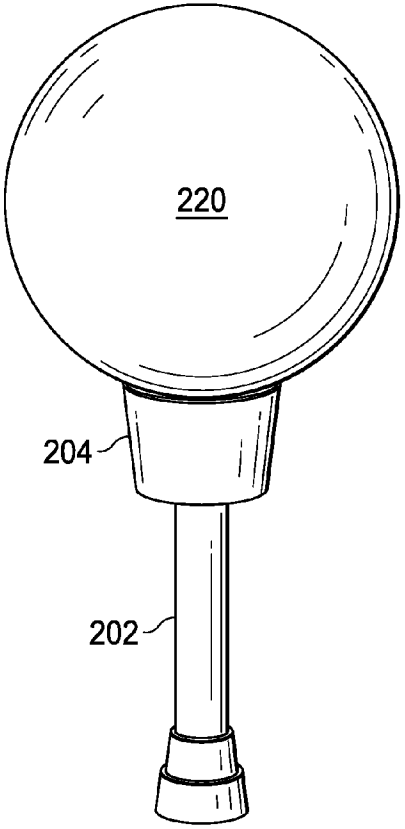
FIG. 2B (PRIOR ART)
FIGS. 2A and 2B are side views of a typical spring probe pin for electrically testing solder balls on a BGA package.
Figure 2A:
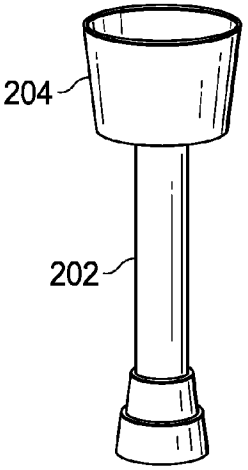
FIG. 2A (PRIOR ART)
Figure 4B:
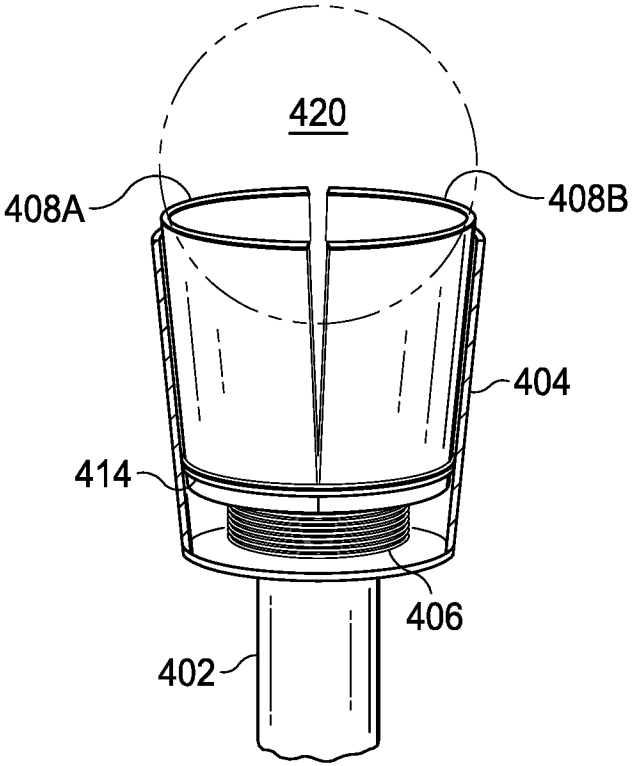
FIGS. 4A and 4B are side views of an improved BGA spring probe pin for electrically testing solder balls on a BGA package.
Figure 4A:
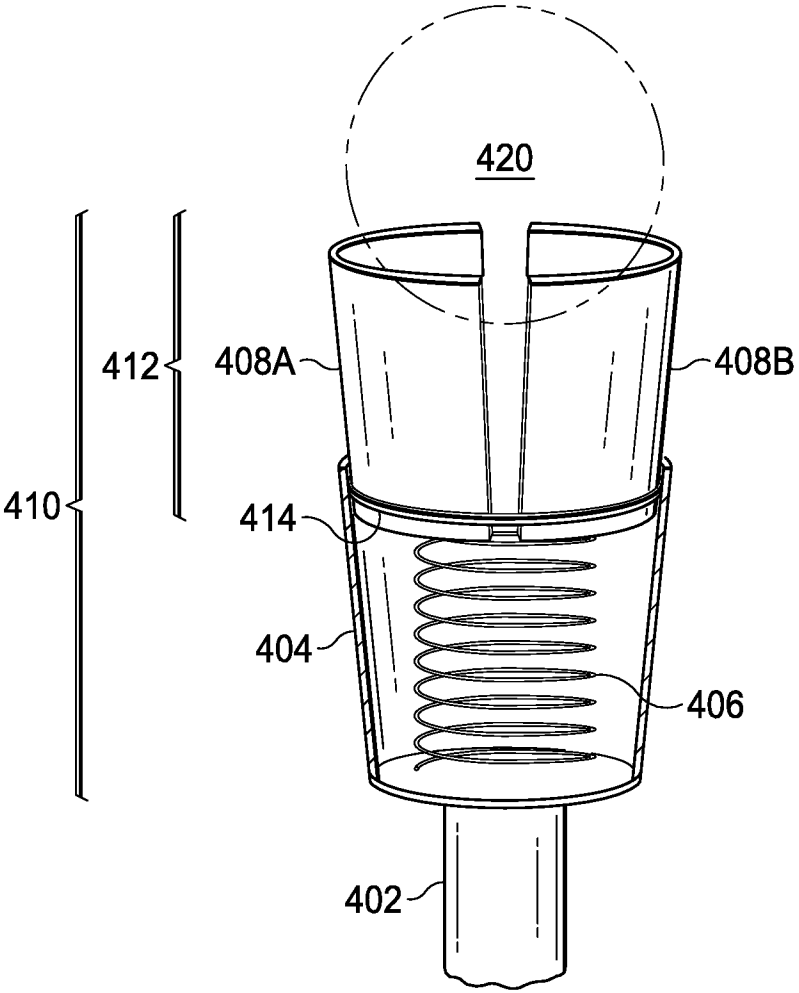

An improved BGA Pogo™ pin connector design is illustrated in FIGS. 4A and 4B.

As shown in FIG. 4A a spring actuated solder ball receptacle 410 is mounted on the Pogo™ pin plunger 402. The spring actuated solder ball receptacle 410 consists of a receptacle cylinder 404 with a closed bottom and open top that contains a spring actuated solder ball clamp 412. The spring actuated solder ball clamp 412 consists of a split cylinder, 408A and 408B, with a diameter slightly larger than the solder balls 420. The individual sides, 408A and 408B, of the split cylinder are held together at the bottom by a wire snap ring 414. A ball clamp spring 406 is positioned between the bottom of the receptacle cylinder 404 and the bottom of the spring actuated solder ball clamp 412. The split cylinder is comprised of at least two cylindrical pieces held together at the bottom by the wire snap ring 414 and operable so that the upper portion of the split cylinder 412 moves in and out of the receptacle cylinder 404 as the ball clamp spring 406 is compressed and uncompressed.

When not probing a solder ball 420, the ball clamp spring 406 is uncompressed so that the upper portion of the split cylinder, 408A and 408B, protrudes from the open top of the receptacle cylinder 404. When the upper portion of the split cylinder, 408A and 408B, protrudes from the open top of the receptacle cylinder, the pressure exerted by the wire snap ring 412 on the bottoms of the pieces of the split cylinder, 408A and 408 B, causes the upper ends of the split cylinder to spread apart.

During the probing of a solder ball 420 on a BGA package, the spring actuated solder ball receptacle 410 is lowered until the upper ends of the split cylinder, 408A and 408B, come into contact with the solder ball 420. Since the upper ends of the split cylinder, 408A and 408B, are spread apart, they come into contact with the outer circumference of the solder ball 420.

As the improved BGA spring probe is additionally lowered, the ball clamp spring 406 is compressed and the spring actuated solder ball receptacle 410, slides into the receptacle cylinder 404 forcing the upper ends of the split cylinder, 408A and 408B, together and to firmly contact the sides of the solder ball 420. In this manner good electrical contact to the solder balls is achieved even when the solder balls are of a non uniform size or irregular shape.

The improved BGA Pogo™ pin connector design reduces probe failures that result from poor electrical contact to irregular size and shaped solder balls. The improved BGA Pogo™ pin connector design provides increased surface area contact to the solder ball for improved electrical contact. This results in an improved first pass yield and a reduction in the number of parts that a reprobed.

In addition the improved BGA Pogo™ pin connector design reduces probe station down time for BGA Pogo™ pin cleaning, for BGA Pogo™ pin replacement, and BGA probe head realignment.

Figure 5A:
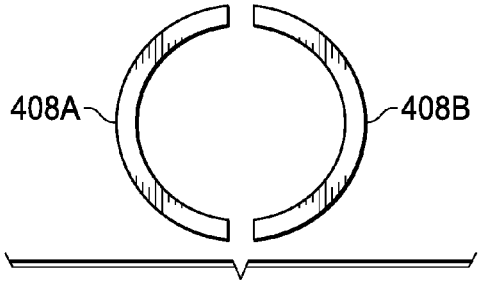
FIGS. 5A, 5B, 5C, and 5D are top down views of split cylinder designs that may be used in an improved BGA spring probe pin.
Figure 5B:
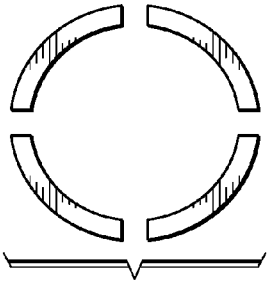
Figure 5C:
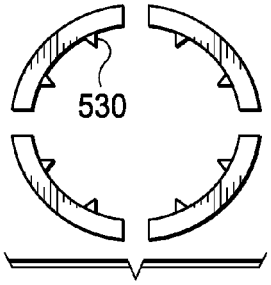
Figure 5D:
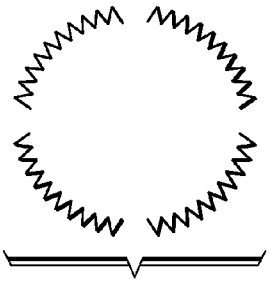

The split cylinder 412 described has two parts, 408A and 408B, as shown in a top down view in FIG. 5A. A few alternative split cylinder designs are illustrated in FIGS. 5B, 5C, and 5D. The example split cylinder designs are meant to be illustrative and are not limiting in any way.

The split cylinder may have any number of parts. A top down view of a split cylinder with 4 parts is illustrated in FIG. 5B.

The parts of the split cylinder may have smooth surfaces as shown in FIGS. 5A and 5B or may have ribs 530 or points 530 on the inner surfaces of the split cylinder parts as shown in FIG. 5C. The ribs 530 or points 530 may increase the force on the solder balls and may improve electrical contact.

The top down view of a split cylinder design with corrugated sections is illustrated in FIG. 5D. The corrugations may provide increased pressure against the solder ball for improved electrical contact.

Figure 6A:
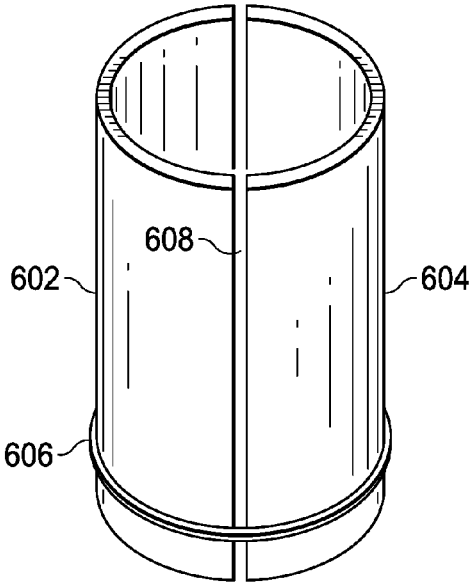
FIGS. 6A and 6B are side views of split cylinder designs that may be used in an improved BGA spring probe pin.

FIG. 6A shows a side view of a first embodiment of the split cylinder illustrated in FIG. 5A. Two half cylinders 602 and 604 are held together at the bottom by a wire snap ring 606. In this embodiment the separation 608 between the two half cylinders 602 and 604 is constant.

Figure 6B:
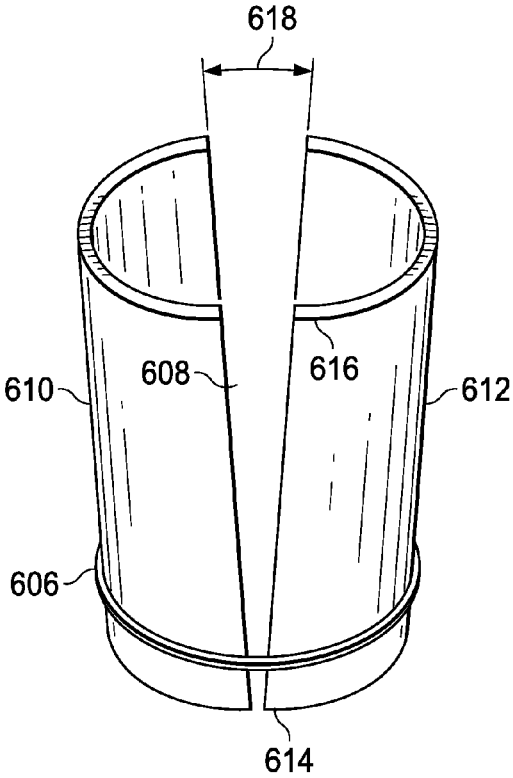

FIG. 6B shows a side view of a second embodiment of the split cylinder illustrated in FIG. 5A. Two half cylinders 610 and 612 are held together at the bottom by a wire snap ring 606. In this embodiment the upper portions of the two half cylinders 610 and 612 are angled away from each other by an angle 618 in the range of about 2 to 10 degrees just above the wire snap ring 606. This angle may facilitate the upper portions of the two half cylinders 610 and 612 spreading apart when ball clamp spring is uncompressed and the upper portions of the two half cylinders 610 and 612 protrude from the top of the receptacle cylinder 404. In this design the diameter of the bottom 614 of the split cylinder may be slightly smaller than the diameter of the top 616.

Figure 7:
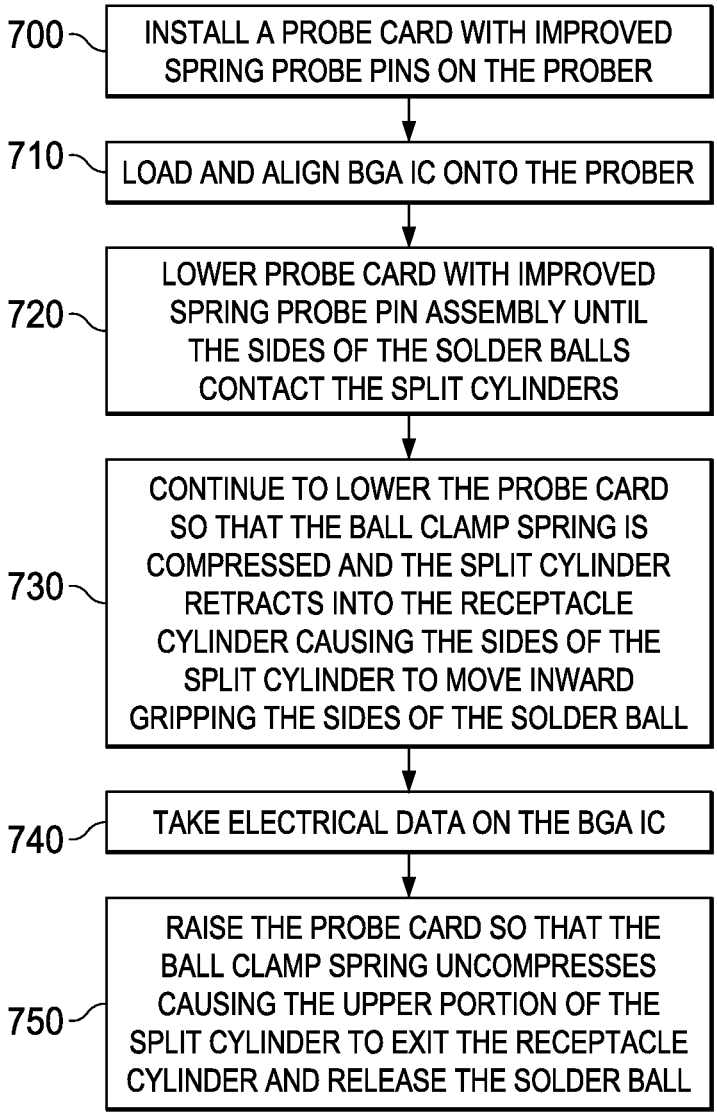
FIG. 7 is a flow diagram illustrating the steps in the operation of a BGA prober with improved BGA spring probe pins.

The operation of the improved BGA spring probe pin is described in the flow diagram in FIG. 7

In step 700 a probe card with improved BGA spring probe pins is installed on the prober.

In step 710 a BGA package is loaded into the prober with the solder balls facing up.

In step 720 the probe card with the improved BGA spring probe pins is lowered until the inside surfaces of the upper portion of the split cylinders contact the sides of the solder balls.

In step 730 the probe card is additionally lowered causing the ball clamp spring to compress and causing the split cylinders into the cylindrical receptacles. The upper portion of the split cylinders are forced together against the sides of the solder balls as they retract into the cylindrical receptacle ensuring good electrical contact.

In step 740 the prober takes the electrical data on the BGA IC.

In step 750 the probe card is raised so that the ball clamp spring uncpmpresses causing the upper portions of the split cylinders to emerge from the receptacles and to release the solder balls.

While various embodiments of the present disclosure have been described above, it should be understood that they have been presented by way of example only and not limitation. Numerous changes to the disclosed embodiments can be made in accordance with the disclosure herein without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A probe pin assembly, comprising:

a cylinder having an open end and a closed end;

split cylindrical pieces insertable into the cylinder, the split cylindrical pieces each having a reception portion movable across the open end of the cylinder; and a ring holding the split cylindrical pieces to form an adjustable receptacle having:

a reception diameter where the reception portion of the split cylindrical pieces sliding away from the open end of the cylinder; and a contact diameter where the reception portion of the split cylindrical pieces sliding towards the open end of the cylinder, the contact diameter smaller than the reception diameter.

2. The probe pin assembly of claim 1, further comprising:

a plunger connected to the closed end of the cylinder.

3. The probe pin assembly of claim 1, further comprising:

means for adjusting the adjustable receptacle between having the contact diameter and having the reception diameter.

4. The probe pin assembly of claim 1, wherein the means for adjusting the adjustable receptacle includes a spring connecting to the closed end of the cylinder and the adjustable receptacle.

5. The probe pin assembly of claim 1, wherein:

the split cylindrical pieces each includes an insertion portion placed in the cylinder; and the ring holds the insertion portions of the split cylindrical pieces inside the cylinder.

6. The probe pin assembly of claim 1, wherein the ring includes a wire snap ring.

7. The probe pin assembly of claim 1, wherein the reception portions of the split cylindrical pieces are spaced apart at an angle ranging between 2 degrees and 10 degrees when the adjustable receptacle is having the reception diameter.

8. The probe pin assembly of claim 1, wherein the closed end of the cylinder has a first diameter, and the open end of the cylinder has a second diameter greater than the first diameter.

9. The probe pin assembly of claim 1, wherein the reception diameter is sized to receive a solder ball.

10. The probe pin assembly of claim 1, wherein the contact diameter is sized to contact a solder ball and secure the solder ball partially within the cylinder.

11. The probe pin assembly of claim 1, wherein the adjustable receptacle has a ribbed inner surface.

12. The probe pin assembly of claim 1, wherein the adjustable receptacle has a corrugated inner surface.

13. A probe pin assembly, comprising:

a cylinder having an open end and a closed end; and an adjustable receptacle having an insertion portion inside the cylinder and a reception portion movable across the open end of the cylinder, the reception portion having:

a first diameter where the insertion portion is closer to the open end than the closed end, the first diameter is sized to receive a solder ball; and a second diameter where the insertion portion is closer to the closed end than the open end, the second diameter smaller than the first diameter, and the second diameter sized to contact the solder ball and secure the solder ball partially within the cylinder.

14. The probe pin assembly of claim 13, further comprising:

a plunger connected to the closed end of the cylinder.

15. The probe pin assembly of claim 13, further comprising:

means for adjusting the adjustable receptacle between having the first diameter and having the second diameter.

16. The probe pin assembly of claim 13, wherein the means for adjusting the adjustable receptacle includes a spring connecting to the closed end of the cylinder and the adjustable receptacle.

17. The probe pin assembly of claim 13, wherein the adjustable receptacle includes:

split cylindrical pieces; and a wire snap ring holding the split cylindrical pieces inside the cylinder.

18. The probe pin assembly of claim 13, wherein the adjustable receptacle has a ribbed inner surface.

19. The probe pin assembly of claim 13, wherein the adjustable receptacle has a corrugated inner surface.

* * * * *